US009543722B2

(12) United States Patent
Kato et al.

(10) Patent No.: US 9,543,722 B2
(45) Date of Patent: Jan. 10, 2017

(54) CONNECTOR FOR SUPPORTING ELECTRONIC DEVICE

(71) Applicant: ACES ELECTRONICS CO., LTD., Zhongli, Taoyuan County (TW)

(72) Inventors: Nobukazu Kato, Fussa (JP); Saeyong Shin, Yokohama (JP)

(73) Assignee: ACES ELECTRONICS CO., LTD., Zhongli, Taoyuan County (TW)

( * ) Notice: Subject to any disclaimer, the term of this patent is extended or adjusted under 35 U.S.C. 154(b) by 0 days.

(21) Appl. No.: 14/802,579

(22) Filed: Jul. 17, 2015

(65) Prior Publication Data

US 2016/0036176 A1 Feb. 4, 2016

(30) Foreign Application Priority Data

Aug. 1, 2014 (JP) ..... 2014-157966

(51) Int. Cl.

| | |
|---|---|
| ***H01R 13/64*** | (2006.01) |
| ***H01R 31/06*** | (2006.01) |
| *H01R 107/00* | (2006.01) |
| *H01R 24/62* | (2011.01) |

(52) U.S. Cl.

CPC ..... *H01R 31/06* (2013.01); *H01R 24/62* (2013.01); *H01R 2107/00* (2013.01)

(58) Field of Classification Search

CPC ..... H01R 31/06
USPC ..... 439/676, 562, 929; 361/679.01
See application file for complete search history.

(56) References Cited

U.S. PATENT DOCUMENTS 4,583,797 A * 4/1986 Engelmore ..... H01R 39/64 439/22
4,590,337 A * 5/1986 Engelmore ..... H04M 1/02 191/12 R
4,673,228 A * 6/1987 Ditzig ..... H01R 39/64 439/13

(Continued)

FOREIGN PATENT DOCUMENTS

JP 2006173473 A 6/2006

*Primary Examiner* — Tulsidas C Patel
*Assistant Examiner* — Peter G Leigh
(74) *Attorney, Agent, or Firm* — Chiesa Shahinian & Giantomasi PC

(57) ABSTRACT

Provided is a connector including a case having an opposing surface facing external device and a flat plate-shaped contact built in the case. The case includes a first opening which is formed at the opposing surface and through which a contact point of the contact to be connected to a connection terminal of the external device protrudes from the opposing surface, a receiver configured to receive a connector for external connection, and a holder configured to hold the contact. The contact includes the contact point which is disposed in the first opening and which is to contact with the connection terminal of the external device, an elastic portion which is disposed in the case and which moves the contact point in a substantially perpendicular direction relative to the opposing surface, a contact portion which is disposed in the receiver and which is to contact with a connection terminal of the connector for external connection, a held portion which is formed between the elastic portion and the contact portion and which is held by the holder in the case, and a connection portion which is formed between the elastic portion and the contact portion and which connects between the contact point and the contact portion in the case.

20 Claims, 32 Drawing Sheets

(56) References Cited

U.S. PATENT DOCUMENTS 4,764,121 A * 8/1988 Ditzig ..... H01R 39/64 29/883
RE32,805 E * 12/1988 Engelmore ..... H01R 39/64 439/24
5,049,083 A * 9/1991 Lin ..... H04M 1/15 439/21
5,106,306 A * 4/1992 Ditzig ..... H01R 39/64 439/26
5,807,123 A * 9/1998 Spiegelaar ..... H01R 13/05 439/136
6,065,974 A * 5/2000 Schempp ..... H01R 39/64 439/26
6,077,130 A * 6/2000 Hughes ..... H01R 13/2442 439/65
6,875,049 B2 * 4/2005 Kyowski ..... H01R 11/282 439/500
6,951,488 B2 * 10/2005 Hsieh ..... H01R 12/7011 439/500
7,357,665 B1 * 4/2008 Yan ..... H01R 13/2442 439/500
7,803,011 B1 * 9/2010 Mai ..... H01R 13/2428 439/500
8,616,922 B2 * 12/2013 Liu ..... H01R 12/57 439/669
8,668,529 B2 * 3/2014 Park ..... H01R 12/714 439/700
9,072,186 B2 * 6/2015 Mobed ..... H05K 7/10
2005/0037635 A1 * 2/2005 Hsu ..... H01R 9/096 439/66
2008/0081495 A1 * 4/2008 Long ..... H01R 13/2442 439/141
2009/0047846 A1 * 2/2009 Zhang ..... H01R 12/57 439/816
2015/0311619 A1 * 10/2015 Kato ..... H01R 13/6594 439/137
2015/0318653 A1 * 11/2015 Carnevali ..... H01R 43/005 29/842

* cited by examiner

CONNECTOR FOR SUPPORTING ELECTRONIC DEVICE

CROSS-REFERENCE TO RELATED APPLICATIONS

The following priority application is incorporated herein by reference in its entirety: Japanese Patent Application No. 2014-157966 filed on Aug. 1, 2014.

TECHNICAL FIELD

The present invention relates to a connector to be connected to connection terminals of electronic device.

BACKGROUND ART

A personal digital assistance cradle has been heretofore known, which includes a circuit board on which a first connector with spring-shaped terminals to be connected to connection terminals of a personal digital assistance and a second connector to be connected to a cable (e.g., a USB cable) for connection to an information processing unit are mounted (e.g., Patent Literature 1). Moreover, a pogo pin connector has been also known, which includes, instead of the spring-shaped terminals, a plurality of movable pins (pogo pins) being extendable by springs.

CITATION LIST

Patent Literature

Patent Literature 1: JP 2006-173473 A

SUMMARY OF INVENTION

Technical Problem

However, the above-described personal digital assistance cradle includes the circuit board formed with connection lines each connecting each of the spring-shaped terminals of the first connector to a corresponding one of a plurality of terminals of the second connector, resulting in the disadvantage that a body size is large. Moreover, since a similar circuit board is provided at the pogo pin connector including the pogo pins, there are disadvantages that a connector body size is large and that a manufacturing cost is high.

The present invention is intended to provide a connector realizing compactification and manufacturing cost reduction.

Solution to Problem

According to the present invention, there is provided a connector including: a case having an opposing surface facing external device; and a flat plate-shaped contact built in the case, wherein the case includes a first opening which is formed at the opposing surface and through which a contact point of the contact to be connected to a connection terminal of the external device protrudes from the opposing surface, a receiver configured to receive a connector for external connection, and a holder configured to hold the contact, and the contact includes the contact point which is disposed in the first opening and which is to contact with the connection terminal of the external device, an elastic portion which is disposed in the case and which moves the contact point in a substantially perpendicular direction relative to the opposing surface, a contact portion which is disposed in the receiver and which is to contact with a connection terminal of the connector for external connection, a held portion which is formed between the elastic portion and the contact portion and which is held by the holder in the case, and a connection portion which is formed between the elastic portion and the contact portion and which connects between the contact point and the contact portion in the case.

Moreover, in the connector according to the present invention, the case includes a case body having the receiver and the holder, and a protective case having the opposing surface formed with the first opening, the case body includes a second opening for attachment of the protective case at a surface of the case body facing the external device, and the protective case is attached to the second opening of the case body to move in the substantially perpendicular direction relative to the opposing surface.

Moreover, in the connector according to the present invention, the holder has a holding surface which holds the held portion of the contact and which is substantially parallel to the opposing surface.

Moreover, the connector according to the present invention further includes: the plurality of contacts, wherein the case includes the at least one first opening through which each of the contact points included by each of the contacts protrudes from the opposing surface.

Moreover, in the connector according to the present invention, the connection portion includes a pitch changer configured to, when an arrangement pitch of the contact points of the contacts and an arrangement pitch of contact portions of the contacts are different from each other, change the arrangement pitch of the contact points of the contacts.

Moreover, in the connector according to the present invention, the connection portion includes an arrangement order changer configured to, when an arrangement order of the contact points of the contacts and an arrangement order of the contact portions of the contacts are different from each other, change the arrangement order of the contact points of the contacts.

Moreover, in the connector according to the present invention, the contacts include first and second contacts forming a differential pair, and the first and second contacts are configured such that a length of the first contact from a contact point to a contact portion is identical to a length of the second contact from a contact point to a contact portion.

Moreover, in the connector according to the present invention, the first and second contacts are formed in a planar or three-dimensional shape.

Moreover, in the connector according to the present invention, the first and second contacts are arranged such that a middle position of a line connecting between the contact point of the first contact and the contact point of the second contact and a middle position of a line connecting between the contact portion of the first contact and the contact portion of the second contact are on a line extending perpendicular to an arrangement direction of the contact points and an arrangement direction of the contact portions.

Moreover, in the connector according to the present invention, the connector for external connection is a MicroUSB connector, a USBType-C connector, or a USB3.1 connector.

Moreover, in the connector according to the present invention, an inserting and removing direction of the connector for external connection is a substantially parallel direction relative to the opposing surface direction, a substantially perpendicular direction relative to the opposing surface, or a direction inclined relative to the opposing surface, and an arrangement direction of the contact points and an arrangement direction of the contact portions are substantially parallel to each other.

Moreover, in the connector according to the present invention, an inserting and removing direction of the connector for external connection is a substantially parallel direction relative to the opposing surface direction, a substantially perpendicular direction relative to the opposing surface, or a direction inclined relative to the opposing surface, and an arrangement direction of the contact points and an arrangement direction of the contact portions are substantially perpendicular to each other.

Moreover, the connector according to the present invention further includes: a fixing portion configured to, while the contact point is connected to the connection terminal of the external device, fix the external device on the case.

Moreover, in the connector according to the present invention, the case includes a first case having a surface facing the external device and a second case having the holder, the first and second cases are connected together in a direction facing the external device, and the fixing portion is provided at the second case.

Moreover, the connector according to the present invention further includes: a first shell which is inserted into the case and which has, at a surface facing the external device, a connecting portion to be connected to the external device; and a second shell which is formed in the receiver and which contacts the first shell, wherein the first shell is in such a shape that the first shell covers at least the elastic portion and the held portion.

Advantageous Effects of Invention

According to the present invention, a connector can be provided, which can realize compactification and manufacturing cost reduction and which has excellent high-speed transmission characteristics.

DESCRIPTION OF EMBODIMENTS

Figure 1:
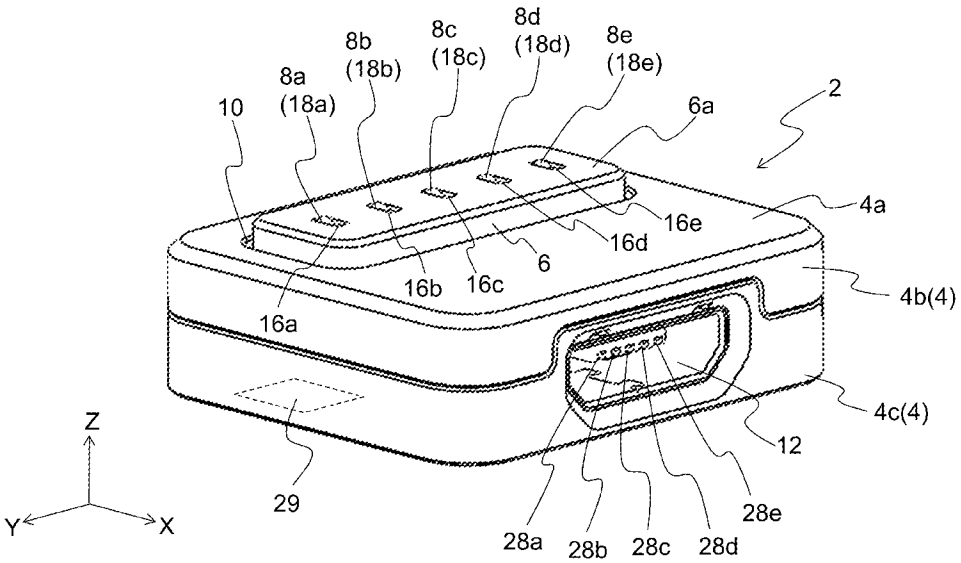
FIG. 1 is a perspective view illustrating the exterior appearance of a connector of a first embodiment.

A connector of a first embodiment of the present invention will be described below with reference to drawings. FIG. 1 is a perspective view illustrating the exterior appearance of the connector of the first embodiment. Note that an XYZ orthogonal coordinate system is set in the drawings (FIGS. 1 to 4) illustrating, e.g., the configuration of the connector of the present embodiment, and, e.g., the position relationship among members will be described with reference to such an orthogonal coordinate system. It is set such that an X-axis is parallel to a inserting direction in which a later-described MicroUSB connector is inserted into a later-described receiver 12, that a Y-axis is parallel to the arrangement direction of a plurality of later-described contacts 8*a* to 8*e*, and that a Z-axis is perpendicular to the upper surface of a later-described case body 4. Moreover, it is set such that a removing direction in which the MicroUSB connector is removed is a positive X-direction, that the inserting direction in which the MicroUSB connector is inserted is a negative X-direction, that the direction toward the contact 8*a* is a positive Y-direction, that the direction toward the contact 8*e* is a negative Y-direction, that the direction toward the upper surface of the case body 4 is a positive Z-direction, and that the direction toward the lower surface of the case body 4 is a negative Z-direction.

As illustrated in FIG. 1, a connector 2 includes the case body 4, a protective case 6, the plurality of contacts 8*a* to 8*e*

(in the present embodiment, five contacts), a magnet 29*a*, and a not-shown magnet. In the connector 2, external device (not shown) such as a personal digital assistance is pressed against the upper surface of the protective case 6. Accordingly, each of contact points 18*a* to 18*e* of the contacts 8*a* to 8*e* comes into contact with a corresponding one of connection terminals of the external device, and then, the contact points 18*a* to 18*e* and the connection terminals are electrically connected together.

The case body 4 is configured such that an upper case 4*b* and a lower case 4*c* formed of insulating members are connected together in the perpendicular direction (the Z-direction), and the contacts 8*a* to 8*e* are built in the case body 4. Moreover, at the surface of the case body 4 (the upper case 4*b*) facing the external device, i.e., the surface 4*a* of the case body 4 on the upper side (a positive Z-direction side), a rectangular second opening 10 for attachment of the protective case 6 is formed. Further, the case body 4 (the lower case 4*c*) includes the receiver 12 configured to receive a connector for external connection (in the present embodiment, a not-shown MicroUSB connector).

Figure 2:
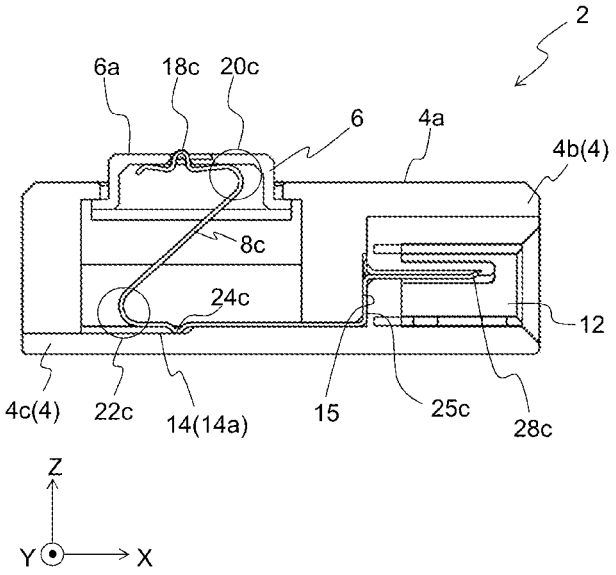
FIG. 2 is a cross-sectional view illustrating the configuration of the connector of the first embodiment.

FIG. 2 is a view of the XZ cross section of the connector 2 of the first embodiment from a positive Y-direction side. As illustrated in FIG. 2, the case body 4 (the lower case 4*c*) includes a holder 14 configured to hold held portions 24*a* to 24*e* (see FIG. 3) of the contacts 8*a* to 8*e*, and the holder 14 has a holding surface 14*a* substantially parallel to an opposing surface 6*a* (the XY plane). The holder 14 is provided to receive the elastic force of elastic portions 20*a* to 20*e*, 22*a* to 22*e* (see FIG. 3) of the contacts 8*a* to 8*e*. The case body 4 (the lower case 4*c*) further includes a holder 15 configured to hold held portions 25*a*, 25*c* and three not-shown held portions of the contacts 8*a* to 8*e* (see FIG. 3), and the holder 15 is provided to prevent the contacts 8*a* to 8*e* from displacing relative to the case body 4 due to pressing force generated when the MicroUSB connector is pressed into the receiver 12.

As illustrated in FIG. 1, the protective case 6 has the opposing surface 6*a* facing the external device, and is attached to the second opening 10 of the case body 4 so as to be movable in the direction (the Z-direction) substantially perpendicular to the opposing surface 6*a*. Moreover, at the opposing surface 6*a* of the protective case 6, first openings 16*a* to 16*e* through each of which a corresponding one of the contact points 18*a* to 18*e* protrudes from the opposing surface 6*a* are formed.

Figure 3:
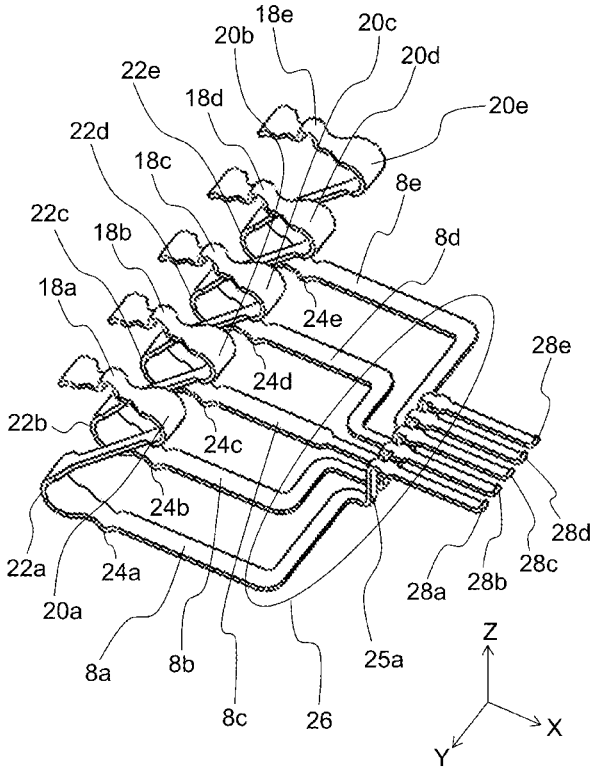
FIG. 3 is a perspective view illustrating the configuration of a contact of the first embodiment.
Figure 4:
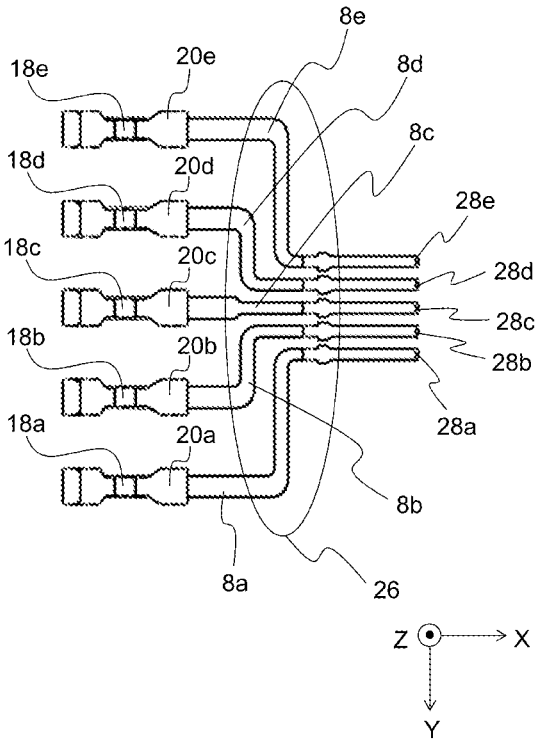
FIG. 4 is a plan view illustrating the configuration of the contact of the first embodiment.

FIG. 3 is a perspective view illustrating the configuration of five contacts 8*a* to 8*e* of the connector 2 of the first embodiment, and FIG. 4 is a plan view of such a configuration from the above. Each of the contacts 8*a* to 8*e* is in a flat plate shape, and as illustrated in FIGS. 1 to 4, includes a corresponding one of the contact points 18*a* to 18*e*; corresponding ones of the elastic portions 20*a* to 20*e*, 22*a* to 22*e*; a corresponding one of the held portions 24*a* to 24*e*; a corresponding one of the held portions 25*a*, 25*c* and three not-shown held portions; a connection portion 26; and a corresponding one of contact portions 28*a* to 28*e*. Each of the contact points 18*a* to 18*e* is disposed in a corresponding one of the first openings 16*a* to 16*e*, and comes into contact with a corresponding one of the connection terminals of the external device when the external device is pressed against the opposing surface 6*a* of the protective case 6. Since the contact points 18*a* to 18*e* are maintained protruding from the opposing surface 6*a*, it is ensured that the contact points 18*a* to 18*e* and the connection terminals of the external device contact each other when the external device is pressed against the opposing surface 6*a* of the protective case 6.

Each of the elastic portions 20*a* to 20*e*, 22*a* to 22*e* is disposed in the case body 4, and moves a corresponding one of the contact points 18*a* to 18*e* in the substantially perpendicular direction (the Z-direction) relative to the opposing surface 6*a*. That is, when the external device is pressed against the opposing surface 6*a*, the elastic portions 20*a* to 20*e*, 22*a* to 22*e* are compressed, and accordingly, the contact points 18*a* to 18*e* and the protective case 6 move in the negative Z-direction. Each of the held portions 24*a* to 24*e* is formed between a corresponding one of the elastic portions 22*a* to 22*e* and a corresponding one of the contact portions 28*a* to 28*e*, and is held by the holding surface 14*a* of the holder 14 in the case body 4. Each of the held portions 25*a*, 25*c* and three not-shown held portions is formed between a corresponding one of the elastic portions 22*a* to 22*e* and a corresponding one of the contact portions 28*a* to 28*e*, and is held by the holder 15 in the case body 4.

The connection portion 26 is formed between each of the elastic portions 22*a* to 22*e* and each of the contact portions 28*a* to 28*e*, and connects between each of the contact points 18*a* to 18*e* and each of the contact portions 28*a* to 28*e* in the case body 4. Moreover, as illustrated in FIGS. 3 and 4, the arrangement pitch (the arrangement interval) of the contact points 18*a* to 18*e* in the arrangement direction (the Y-direction) thereof and the arrangement pitch (the arrangement interval) of the contact portions 28*a* to 28*e* in the arrangement direction (the Y-direction) thereof are different from each other. Thus, the connection portion 26 also functions as a pitch changer configured to change the arrangement pitch of the contact points 18*a* to 18*e*.

Each of the contact portions 28*a* to 28*e* is disposed at the receiver 12, and has the surface exposed in the negative Z-direction in the receiver 12. When the MicroUSB connector is inserted into the receiver 12, each of the contact portions 28*a* to 28*e* comes into contact with a corresponding one of the connection terminals of the MicroUSB connector.

As illustrated in FIG. 1, the magnet 29 is attached on the side (the positive Y-direction side) close to the contact 8*a* in the lower case 4*c*. Moreover, the not-shown magnet is attached on the side (a negative Y-direction side) close to the contact 8*e* in the lower case 4*c*. The magnet 29 and the not-shown magnet are provided as fixing portions configured to fix the external device on the opposing surface 6*a* while each of the contact points 18*a* to 18*e* of the contacts 8*a* to 8*e* is connected to a corresponding one of the connection terminals of the external device.

Note that the magnets serving as the fixing portions are preferably provided at the lower case 4*c* having the holder 14 (the holding surface 14*a*). This is because if the magnets are provided at the upper case 4*b* not including the holder 14, the upper case 4*b* and the lower case 4*c* might be separated from each other. That is, the holder 14 (the holding surface 14*a*) receives external force generated in the negative Z-direction when the external device is pressed against the opposing surface 6*a*. With the magnets provided in the case body 4, fixing force for fixing the external device is generated in the direction (the positive Z-direction) opposite to the external force. Thus, in the case of providing the magnets at the upper case 4*b* not including the holder 14, the fixing force for pressing the upper case 4*b* upward in the positive Z-direction and the external force for pressing the lower case 4*c* in the negative Z-direction repel each other, and as a result, connection between the upper case 4*b* and the lower case 4*c* is weakened. On the other hand, in the case of providing the magnets at the lower case 4*c* including the holder 14, both of the fixing force acting in the positive Z-direction and the external force acting in the negative Z-direction are provided on the lower case 4*c*, and therefore, connection between the upper case 4*b* and the lower case 4*c* is not weakened.

Next, the case where the external device and the MicroUSB connector are inserted into the connector 2 of the first embodiment will be described. When the MicroUSB connector is inserted into the receiver 12 of the connector 2 illustrated in FIGS. 1 and 2, each of the contact portions 28*a* to 28*e* of the contacts 8*a* to 8*e* comes into contact with a corresponding one of the connection terminals of the external device. When the external device is pressed against the opposing surface 6*a* of the protective case 6 of the connector 2 illustrated in FIGS. 1 and 2, each of the contact points 18*a* to 18*e* of the contacts 8*a* to 8*e* comes into contact with a corresponding one of the connection terminals of the MicroUSB connector. Moreover, the magnet 29 and the not-shown magnet fix the external device on the opposing surface 6*a* by magnetic force. Then, the external device and the MicroUSB connector are electrically connected together via the connector 2 so that data communication with the external device and power supply to the external device are performed.

According to the connector of the first embodiment, the contacts each configured to connect between the contact point and the contact portion are built in the case body. Thus, it is not necessary to build a circuit board etc. in the case body, and therefore, the size of a connector body can be reduced. Moreover, a manufacturing cost can be reduced. With the existing MicroUSB connector, data communication with the external device and charging of the external device can be facilitated.

Figure 5:
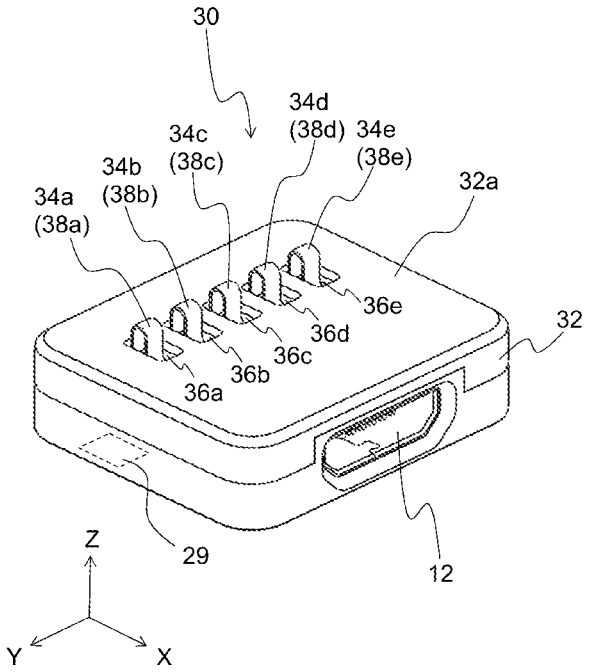
FIG. 5 is a perspective view illustrating the exterior appearance of a connector of a second embodiment.

Next, a connector of a second embodiment of the present invention will be described with reference to drawings. FIG. 5 is a perspective view illustrating the exterior appearance of the connector of the second embodiment. Note that the same reference numerals are used to represent elements of the connector of the second embodiment having the identical configuration to that of the connector 2 illustrated in FIGS. 1 and 2, and the description thereof will not be repeated. In the drawings (FIGS. 5 to 8) illustrating the configuration of the connector etc. of the present embodiment, the XYZ orthogonal coordinate system similar to that illustrated in FIGS. 1 to 4 is also set, and, e.g., the position relationship among members will be described with reference to such an orthogonal coordinate system.

As illustrated in FIG. 5, a connector 30 includes a case 32 and a plurality of contacts 34*a* to 34*e* (in the present embodiment, five contacts). In the connector 30, external device (not shown) such as a personal digital assistance is attached to the upper surface of the case 32. Accordingly, each of contact points 38*a* to 38*e* of the contacts 34*a* to 34*e* comes into contact with a corresponding one of connection terminals of the external device, and then, the contact points 38*a* to 38*e* and the connection terminals are electrically connected together.

Figure 6:
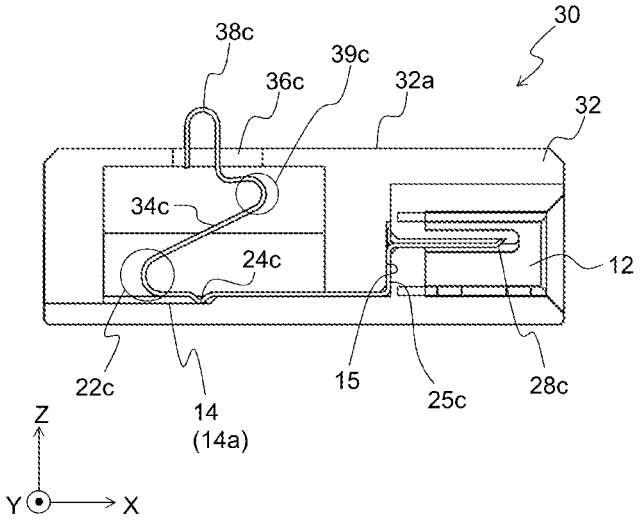
FIG. 6 is a cross-sectional view illustrating the configuration of the connector of the second embodiment.

FIG. 6 is a view of the XZ cross section of the connector 30 of the second embodiment from a positive Y-direction side. The case 32 is substantially in a rectangular parallelepiped shape, and is formed of an insulating member. The contacts 34*a* to 34*e* are built in the case 32. Moreover, as illustrated in FIG. 5, the case 32 has an opposing surface 32*a* facing the external device, and first openings 36*a* to 36*e* through each of which a corresponding one of the contact points 38*a* to 38*e* protrudes from the opposing surface 32*a* are formed at the opposing surface 32*a* of the case 32.

Figure 7:
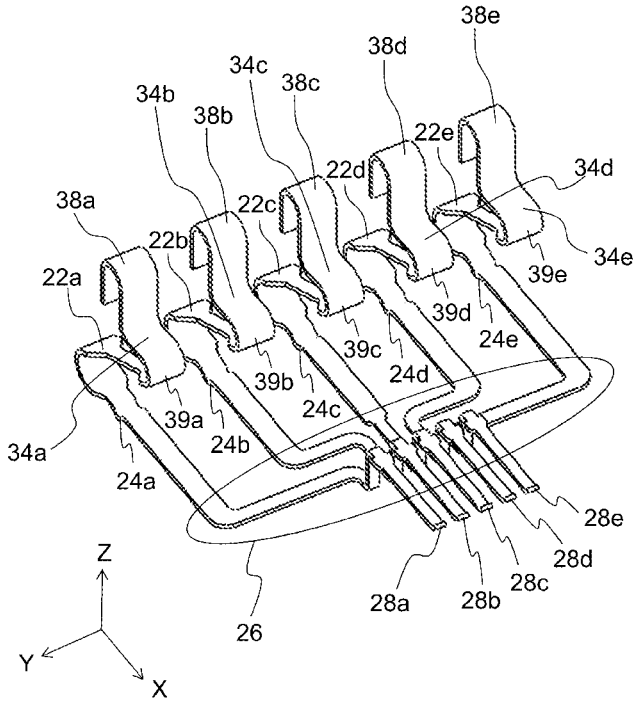
FIG. 7 is a perspective view illustrating the configuration of a contact of the second embodiment.
Figure 8:
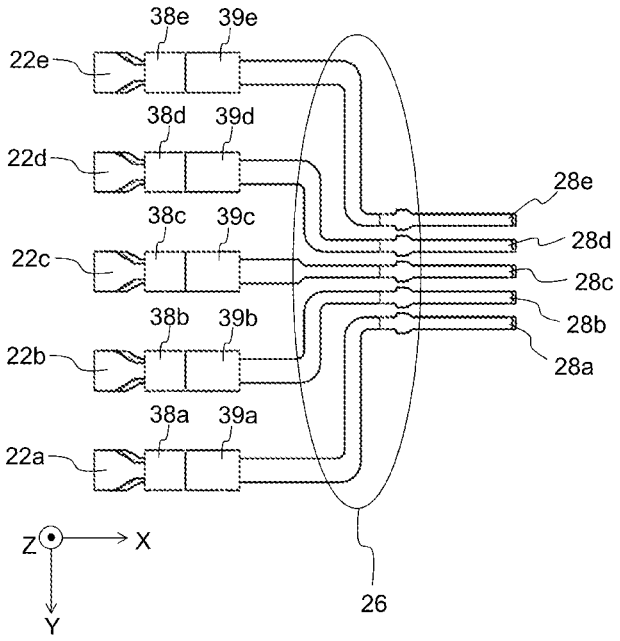
FIG. 8 is a plan view illustrating the configuration of the contact of the second embodiment.

FIG. 7 is a perspective view illustrating the configuration of five contacts 34*a* to 34*e* of the connector 30 of the second embodiment, and FIG. 8 is a plan view of such a configuration from the above. Each of the contacts 34*a* to 34*e* is in a flat plate shape, and as illustrated in FIGS. 5 to 8, includes a corresponding one of the contact points 38*a* to 38*e*; corresponding ones of elastic portions 39*a* to 39*e*, 22*a* to 22*e*; a corresponding one of held portions 24*a* to 24*e*; a corresponding one of held portions 25*a*, 25*c* and three not-shown held portions; a connection portion 26; and a corresponding one of contact portions 28*a* to 28*e*. Each of the contact points 38*a* to 38*e* is disposed in a corresponding one of the first openings 36*a* to 36*e*, and comes into contact with a corresponding one of the connection terminals of the external device when the external device is attached to the opposing surface 32*a* of the case 32.

Each of the elastic portions 39*a* to 39*e*, 22*a* to 22*e* is disposed in the case 32, and moves a corresponding one of the contact points 38*a* to 38*e* in the substantially perpendicular direction (the Z-direction) relative to the opposing surface 32*a*. That is, when the external device is attached to the opposing surface 32*a*, the elastic portions 39*a* to 39*e*, 22*a* to 22*e* are compressed, and accordingly, the contact points 38*a* to 38*e* move in the negative Z-direction.

Next, the case where the external device and a MicroUSB connector are inserted into the connector 30 of the second embodiment will be described. When the MicroUSB connector is inserted into a receiver 12 of the connector 30 illustrated in FIGS. 5 and 6, each of the contact portions 28*a* to 28*e* of the contacts 34*a* to 34*e* comes into contact with a corresponding one of connection terminals of the MicroUSB connector. When the external device is pressed against the opposing surface 32*a* of the case 32 of the connector 30 illustrated in FIGS. 5 and 6, each of the contact points 38*a* to 38*e* of the contacts 34*a* to 34*e* comes into contact with a corresponding one of the connection terminals of the external device. Moreover, a magnet 29 and a not-shown magnet fix the external device on the opposing surface 32*a* by magnetic force. Then, the external device and the MicroUSB connector are electrically connected together via the connector 30 so that data communication with the external device and power supply to the external device are performed.

According to the connector of the second embodiment, the contacts each configured to connect between the contact point and the contact portion are built in the case. Thus, it is not necessary to build a circuit board etc. in the case, and therefore, the size of a connector body can be reduced. Moreover, a manufacturing cost can be reduced. With the existing MicroUSB connector, data communication with the external device and charging of the external device can be facilitated.

Figure 9:
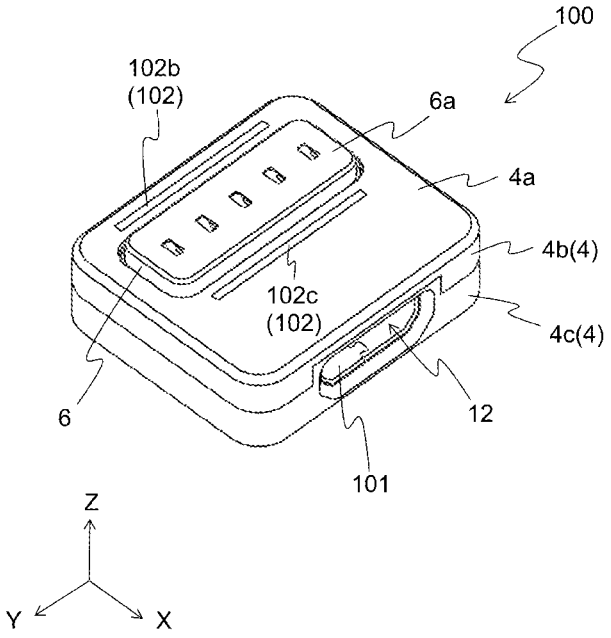
FIG. 9 is a perspective view illustrating the exterior appearance of a connector of a third embodiment.
Figure 10:
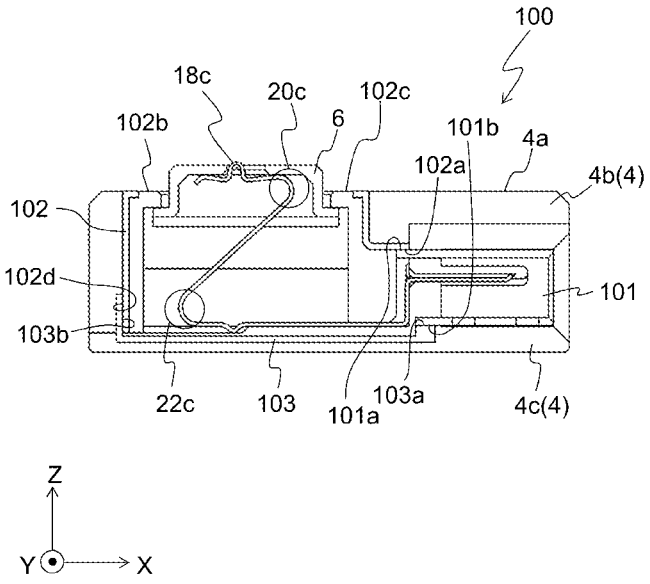
FIG. 10 is a cross-sectional view illustrating the configuration of the connector of the third embodiment.

Next, a connector of a third embodiment of the present invention will be described with reference to drawings. FIG. 9 is a perspective view illustrating the exterior appearance of the connector of the third embodiment, and FIG. 10 is a view illustrating the XZ cross section of the connector of the third embodiment from a positive Y-direction side. Note that the same reference numerals are used to represent elements of the connector of the third embodiment having the identical configuration to that of the connector 2 illustrated in FIGS. 1 and 2, and the description thereof will not be repeated. In the drawings (FIGS. 9 to 13) illustrating the configuration of the connector etc. of the present embodiment, the XYZ orthogonal coordinate system similar to that illustrated in FIGS. 1 to 4 is also set, and, e.g., the position relationship among members will be described with reference to such an orthogonal coordinate system.

Figure 11:
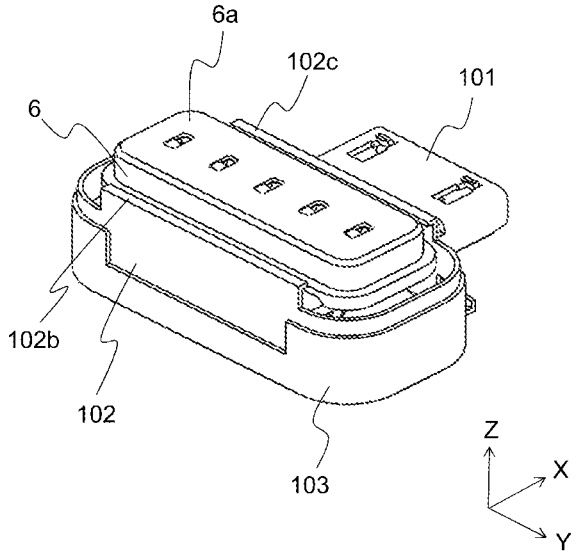
FIG. 11 is a perspective view illustrating the configuration of the inside of a case body of the third embodiment.
Figure 12:
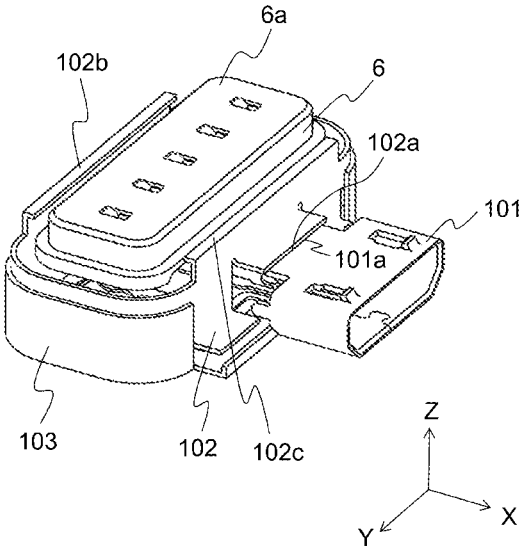
FIG. 12 is a perspective view illustrating the configuration of the inside of the case body of the third embodiment.
Figure 13:
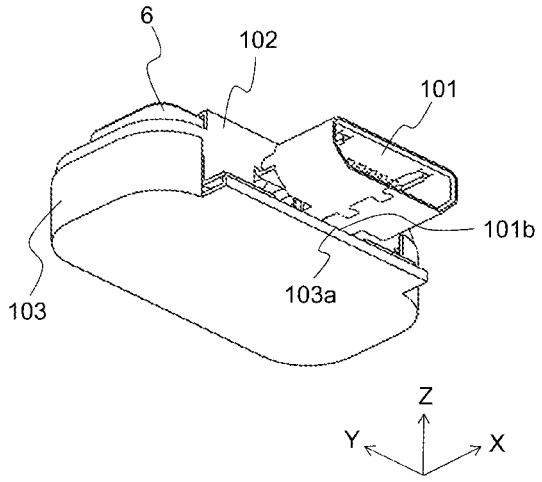
FIG. 13 is a perspective view illustrating the configuration of the inside of the case body of the third embodiment.

As illustrated in FIGS. 9 and 10, a connector 100 includes a MicroUSB connector shell (hereinafter simply referred to as a "connector shell") 101, an upper shell 102, and a lower shell 103. FIGS. 11 and 12 are perspective views illustrating, from the above, the configuration of the inside of a case body 4, and FIG. 13 is a perspective view illustrating, from the below, the configuration of the inside of the case body 4.

The connector shell 101 is formed in a receiver 12, and is press-fitted into a lower case 4*c* of the case body 4. The connector shell 101 contacts the upper shell 102. Specifically, as illustrated in FIGS. 10 and 12, a connector-side contact portion 101*a* of the connector shell 101 and an upper shell contact portion 102*a* of the upper shell 102 are connected together. Moreover, the connector shell 101 contacts the lower shell 103. Specifically, as illustrated in FIGS. 10 and 13, a connector-side contact portion 101*b* of the connector shell 101 and a lower shell contact portion 103*a* of the lower shell 103 are connected together.

The upper shell 102 is insert-molded to an upper case 4*b* of the case body 4, and as illustrated in FIG. 9, connecting portions 102*b*, 102*c* for connecting external device to a surface 4*a* of the case body 4 facing the external device are exposed through the upper shell 102. As illustrated in FIGS. 11 and 12, the upper shell 102 is in such a shape that the upper shell 102 covers elastic portions 20*a* to 20*e*, 22*a* to 22*e*, held portions 24*a* to 24*e*, and a connection portion 26 of contacts 8*a* to 8*e*, and is disposed to contact the lower shell 103 inside of the lower shell 103.

The lower shell 103 is insert-molded to the lower case 4*c* of the case body 4, and as illustrated in FIGS. 11 and 12, is in such a shape that the lower shell 103 covers the elastic portions 20*a* to 20*e*, 22*a* to 22*e*, the held portions 24*a* to 24*e*, and the connection portion 26 of the contacts 8*a* to 8*e*. Moreover, the lower shell 103 is disposed to contact the upper shell 102 outside of the upper shell 102. Note that in the present embodiment, the upper shell 102 and the lower shell 103 are in such a shape that both cover the elastic portions 20*a* to 20*e*, 22*a* to 22*e*, the held portions 24*a* to 24*e*, and the connection portion 26, but at least one of the upper shell 102 or the lower shell 103 may be in such a shape that the one of the upper shell 102 or the lower shell 103 at least covers the elastic portions 20*a* to 20*e*, 22*a* to 22*e* and the held portions 24*a* to 24*e*.

Next, the case where the external device and a MicroUSB connector are inserted into the connector 100 of the third embodiment will be described. When the MicroUSB connector is inserted into the receiver 12 of the connector 100, the connector shell 101 and a plug shell of the MicroUSB connector come into contact with each other. When the external device is pressed against an opposing surface 6*a* of the connector 100, the connecting portions 102*b*, 102*c* of the upper shell 102 and a chassis of the external device come into contact with each other. The connector shell 101 contacting the plug shell of the MicroUSB connector contacts the upper shell 102 and the lower shell 103, and the upper shell 102 contacts the lower shell 103 and the chassis of the external device. Thus, the ground of the plug shell of the MicroUSB connector and the ground of the chassis of the external device are connected together.

According to the connector of the third embodiment, the contacts each configured to connect between the contact point and the contact portion are built in the case body. Thus, it is not necessary to build a circuit board etc. in the case body, and therefore, the size of a connector body can be reduced. Moreover, a manufacturing cost can be reduced. With the existing MicroUSB connector, data communication with the external device and charging of the external device can be facilitated. Moreover, the upper and lower shells which are insert-molded to the case body and which is in such a shape that the upper and lower shells at least cover the elastic portions and the held portions are provided, and are connected to the chassis of the external device and the plug shell of the MicroUSB connector. This can prevent noise caused in the connector from exiting to the outside, and can prevent noise from entering the connector from the outside.

Note that in the connector of the third embodiment, the upper shell 102 is disposed inside the lower shell 103, but the present invention is not limited to such a configuration. For example, the configuration may be employed, in which an upper shell is disposed outside a lower shell.

Figure 14:
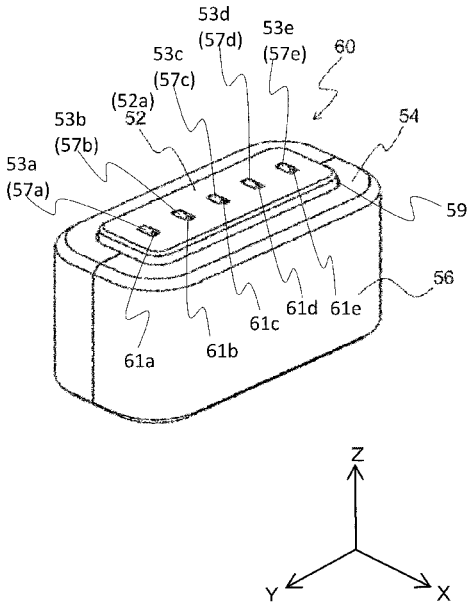
FIG. 14 is a perspective view illustrating the exterior appearance of a connector of a fourth embodiment.
Figure 15:
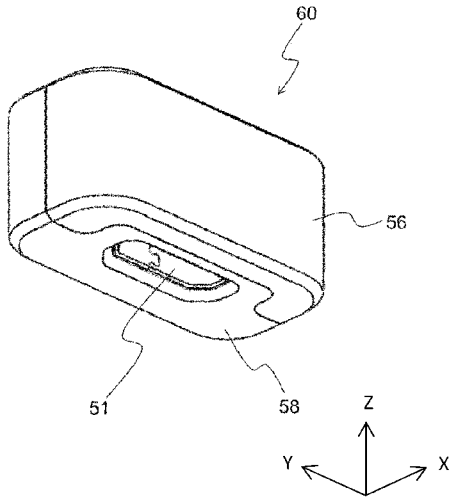
FIG. 15 is a perspective view illustrating the exterior appearance of the connector of the fourth embodiment.

Next, a connector of a fourth embodiment of the present invention will be described with reference to drawings. FIG. 14 is a perspective view illustrating, from the above, the exterior appearance of the connector of the fourth embodiment, and FIG. 15 is a perspective view illustrating such an exterior appearance from the below. Note that the same reference numerals are used to represent elements of the connector of the fourth embodiment having the identical configuration to that of the connector 2 illustrated in FIGS. 1 and 2, and the description thereof will not be repeated. In the drawings (FIGS. 14 to 18) illustrating the configuration of the connector etc. of the present embodiment, the XYZ orthogonal coordinate system similar to that illustrated in FIGS. 1 to 4 is also set, and, e.g., the position relationship among members will be described with reference to such an orthogonal coordinate system. It is set such that the X-axis is parallel to an opposing surface 52*a* along the direction perpendicular to the arrangement direction of a plurality of later-described contacts 53*a* to 53*e*, that the Y-axis is parallel to the arrangement direction of the contacts 53*a* to 53*e*, and that the Z-axis is perpendicular to the upper surface of a later-described case body 56.

Figure 17:
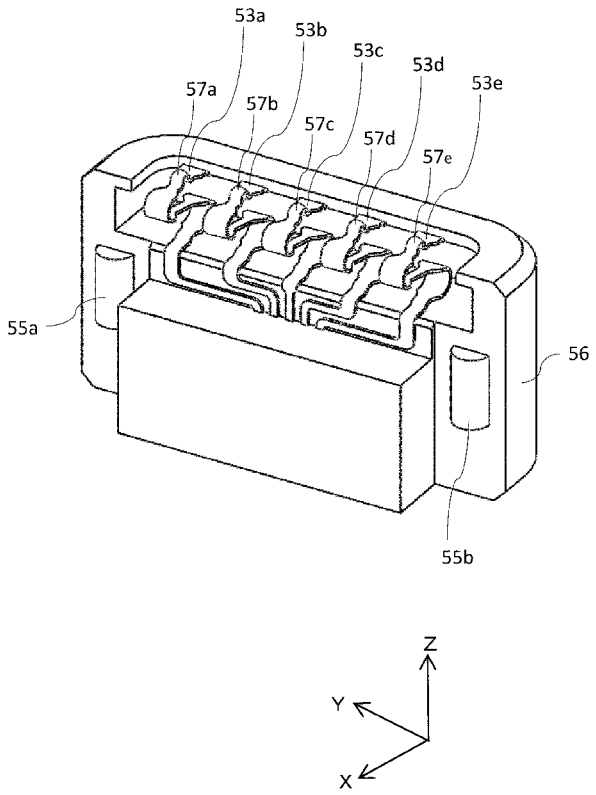
FIG. 17 is a perspective view illustrating the configuration of the inside of a case of the fourth embodiment.

As illustrated in FIGS. 14 and 15, a connector 60 includes the case body 56, a protective case 52, the plurality of contacts 53*a* to 53*e* (in the present embodiment, five contacts), and magnets 55*a*, 55*b* (see FIG. 17). In the connector 60, external device (not shown) such as a personal digital assistance is pressed against the upper surface 52*a* of the protective case 52. Therefore, each of contact points 57*a* to 57*e* of the contacts 53*a* to 53*e* comes into contact with a corresponding one of connection terminals of the external device contact, and then, the contact points 57*a* to 57*e* and the connection terminals are electrically connected together.

As illustrated in FIG. 14, the contacts 53*a* to 53*e* are built in the case body 56. Moreover, at the surface of the case body 56 facing the external device, i.e., a surface 54 of the case body 56 on the upper side (a positive Z-direction side), a rectangular second opening 59 for attachment of the protective case 52 is formed. Further, as illustrated in FIG. 15, the case body 56 includes, at the surface facing the surface 54 facing the external device, i.e., a surface 58 of the case body 56 on the lower side (a negative Z-direction side), a receiver 51 configured to receive a connector for external connection (in the present embodiment, a not-shown MicroUSB connector).

As illustrated in FIG. 14, the protective case 52 has the opposing surface 52*a* facing the external device, and is attached to the second opening 59 of the case body 56 to move in the direction (the Z-direction) substantially perpendicular to the opposing surface 52*a*. Moreover, at the opposing surface 52*a* of the protective case 52, first openings 61*a* to 61*e* through each of which a corresponding one of the contact points 57*a* to 57*e* protrudes from the opposing surface 52*a* are formed.

Figure 16:
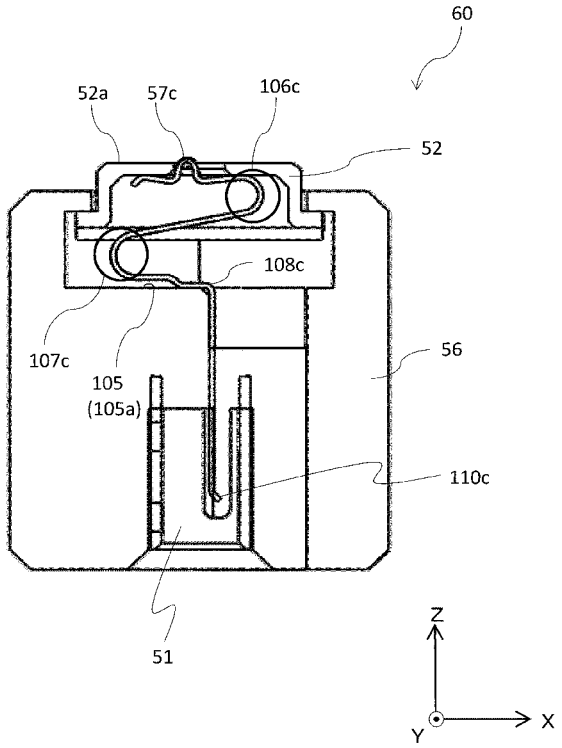
FIG. 16 is a cross-sectional view illustrating the configuration of the connector of the fourth embodiment.

FIG. 16 is a view of the XZ cross section of the connector 60 of the fourth embodiment from a positive Y-direction side. As illustrated in FIG. 16, the case body 56 includes a holder 105 configured to hold held portions 108*a* to 108*e* (see FIG. 18) of the contacts 53*a* to 53*e*, and the holder 105 has a holding surface 105*a* substantially parallel to the opposing surface 52*a* (the XY plane). The holder 105 is provided to receive the elastic force of elastic portions 106*a* to 106*e*, 107*a* to 107*e* (see FIG. 18) of the contacts 53*a* to 53*e*.

FIG. 17 is a perspective view illustrating the configuration of the inside of the case body 56. As illustrated in FIG. 17, the magnet 55*a* is attached to an inner portion of the case body 56 close to the contact 53*a* (the positive Y-direction side). Moreover, the magnet 55*b* is attached to an inner portion of the case body 56 close to the contact 53*e* (a negative Y-direction side). The magnets 55*a*, 55*b* are provided as fixing portions configured to fix the external device on the opposing surface 52*a* while each of the contact points 57*a* to 57*e* of the contacts 53*a* to 53*e* is connected to a corresponding one of the connection terminals of the external device.

Figure 18:
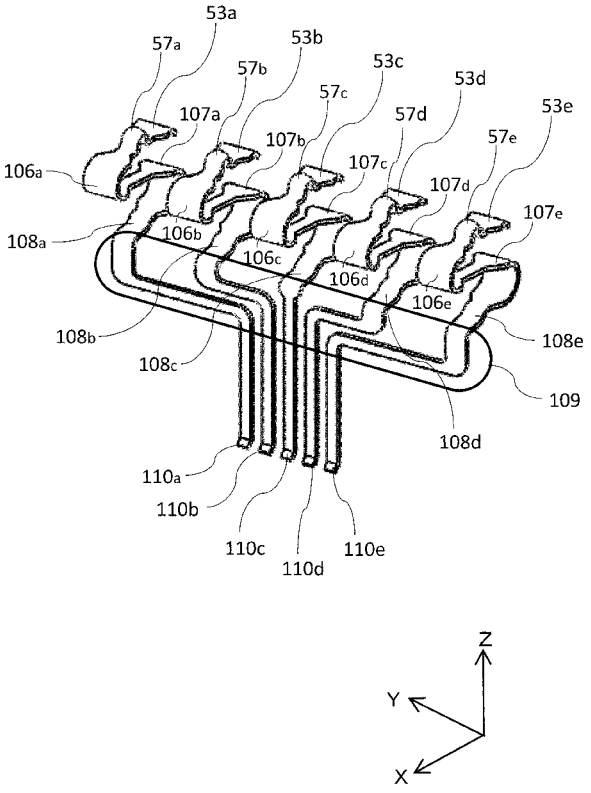
FIG. 18 is a perspective view illustrating the configuration of a contact of the fourth embodiment.

FIG. 18 is a perspective view illustrating the configuration of five contacts 53*a* to 53*e* of the connector 60 of the fourth embodiment. Each of the contacts 53*a* to 53*e* is in a flat plate shape, and as illustrated in FIG. 18, includes a corresponding one of the contact points 57*a* to 57*e*; corresponding ones of the elastic portions 106*a* to 106*e*, 107*a* to 107*e*; a corresponding one of the held portions 108*a* to 108*e*; a connection portion 109; and a corresponding one of contact portions 110*a* to 110*e*. Each of the contact points 57*a* to 57*e* is disposed in a corresponding one of the first openings 61*a* to 61*e*, and comes into contact with a corresponding one of the connection terminals of the external device when the external device is pressed against the opposing surface 52*a* of the protective case 52. Since the contact points 57*a* to 57*e* are maintained protruding from the opposing surface 52*a*, it is ensured that each of the contact points 57*a* to 57*e* contacts a corresponding one of the connection terminals of the external device when the external device is pressed against the opposing surface 52*a* of the protective case 52.

Each of the elastic portions 106*a* to 106*e*, 107*a* to 107*e* is disposed in the case body 56, and moves a corresponding one of the contact points 57*a* to 57*e* in the substantially perpendicular direction (the Z-direction) relative to the opposing surface 52*a*. That is, when the external device is pressed against the opposing surface 52*a*, the elastic portions 106*a* to 106*e*, 107*a* to 107*e* are compressed, and accordingly, the contact points 57*a* to 57*e* and the protective case 52 move in the negative Z-direction. Each of the held portions 108*a* to 108*e* is formed between a corresponding one of the elastic portions 107*a* to 107*e* and a corresponding one of the contact portions 110*a* to 110*e*, and is held by the holding surface 105*a* of the holder 105 in the case body 56.

The connection portion 109 is formed between each of the elastic portions 107*a* to 107*e* and each of the contact portions 110*a* to 110*e*, and connects each of the contact points 57*a* to 57*e* to a corresponding one of the contact portions 110*a* to 110*e* in the case body 56. Moreover, as illustrated in FIG. 18, the arrangement pitch (the arrangement interval) of the contact points 57*a* to 57*e* in the arrangement direction (the Y-direction) thereof and the arrangement pitch (the arrangement interval) of the contact portions 110*a* to 110*e* in the arrangement direction (the Y-direction) thereof are different from each other. Thus, the connection portion 109 also functions as a pitch changer configured to change the arrangement pitch of the contact points 57*a* to 57*e*.

Each of the contact portions 110*a* to 110*e* is disposed at the receiver 51, and has the surface exposed in the negative X-direction in the receiver 51. When the MicroUSB connector is inserted into the receiver 51, each of the contact portions 110*a* to 110*e* comes into contact with a corresponding one of connection terminals of the MicroUSB connector.

Next, the case where the external device and the MicroUSB connector are inserted into the connector 60 of the fourth embodiment will be described. When the MicroUSB connector is inserted into the receiver 51 of the connector 60 illustrated in FIGS. 15 and 16, each of the contact portions 110*a* to 110*e* of the contacts 53*a* to 53*e* comes into contact with a corresponding one of the connection terminals of the MicroUSB connector. When the external device is pressed against the opposing surface 52*a* of the protective case 52 of the connector 60 illustrated in FIGS. 14 and 16, each of the contact points 57*a* to 57*e* of the contacts 53*a* to 53*e* comes into contact with a corresponding one of the connection terminals of the external device. Moreover, the magnets 55*a*, 55*b* fix the external device on the opposing surface 52*a* by magnetic force. Then, the external device and the MicroUSB connector are electrically connected together via the connector 60 so that data communication with the external device and power supply to the external device are performed.

According to the connector of the fourth embodiment, the contacts each configured to connect between the contact point and the contact portion are built in the case body. Thus, it is not necessary to build a circuit board etc. in the case body, and therefore, the size of a connector body can be reduced. Moreover, a manufacturing cost can be reduced. With the existing MicroUSB connector, data communication with the external device and charging of the external device can be facilitated.

Figure 19:
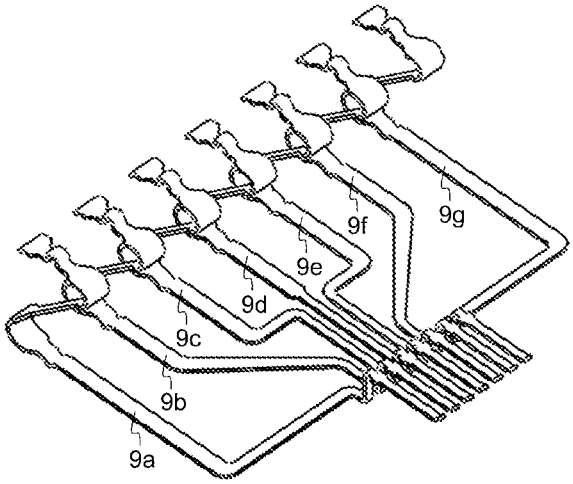
FIG. 19 is a perspective view illustrating the other configuration of the contact of the embodiments.
Figure 20:
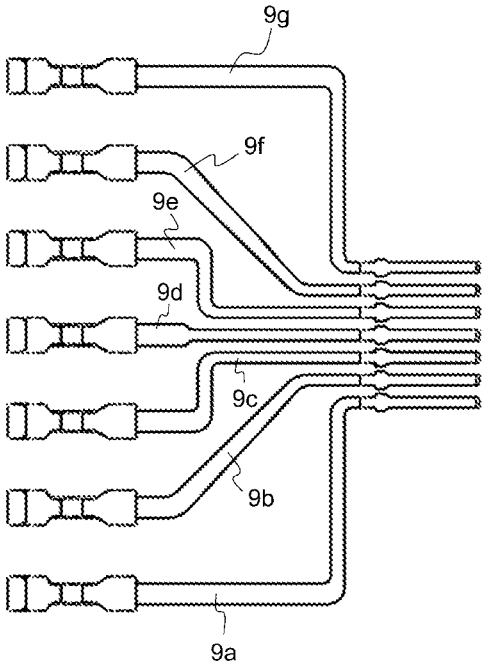
FIG. 20 is a plan view illustrating the other configuration of the contact of the embodiments.

Note that in each of the above-described embodiments, the connector 2 (30, 100) including five contacts 8*a* to 8*e* (34*a* to 34*e*) has been described as an example. However, a connector including one to four contacts or six or more contacts may be employed. As in, e.g., a perspective view of FIG. 19 and a plan view of FIG. 20 from the above, a connector (not shown) may include seven contacts 9*a* to 9*g*.

Figure 21:
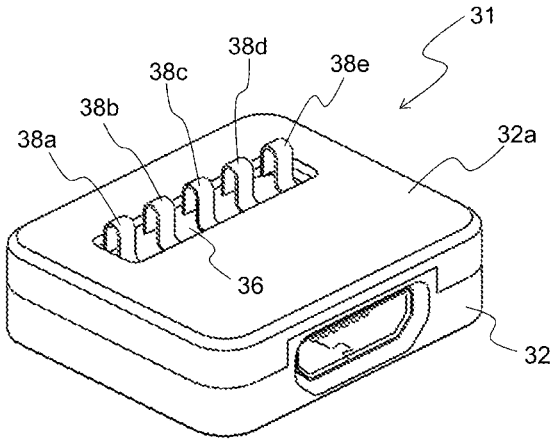
FIG. 21 is a view illustrating the other configuration of the connector of the embodiments.

In each of the above-described embodiments, the configuration in which each of the contact points 18*a* to 18*e* (38*a* to 38*e*) of the contacts 8*a* to 8*e* (34*a* to 34*e*) protrudes from a corresponding one of the first openings 16*a* to 16*e* (36*a* to 36*e*) of the opposing surface 6*a* (32*a*) has been described as an example. However, the configuration may be employed, in which two or more contact points protrude from a single first opening of an opposing surface. As in, e.g., a connector 31 illustrated in FIG. 21, a single first opening 36 through which contact points 38*a* to 38*e* protrude from an opposing surface 32*a* is formed.

Figure 22:
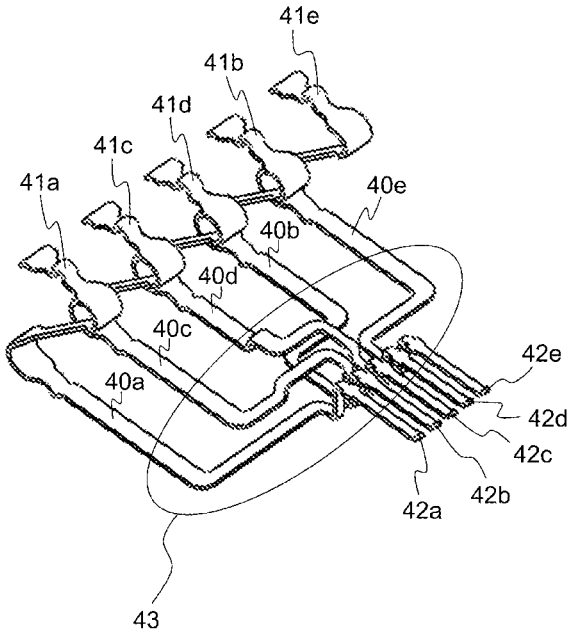
FIG. 22 is a perspective view illustrating the other configuration of the contact of the embodiments.

In each of the above-described embodiments, the following case has been described as an example: the arrangement order of the contact points 18*a* to 18*e* (38*a* to 38*e*) of the contacts 8*a* to 8*e* (34*a* to 34*e*) is the same as that of the contact portions 28*a* to 28*e* of the contacts 8*a* to 8*e* (34*a* to 34*e*), i.e., the arrangement order of the connection terminals of the external device is the same as that of the connection terminals of the MicroUSB connector. On the other hand, the arrangement order of the contact points 18*a* to 18*e* (38*a* to 38*e*) of the contacts 8*a* to 8*e* (34*a* to 34*e*) may be different from that of the contact portions 28*a* to 28*e* of the contacts 8*a* to 8*e* (34*a* to 34*e*). In this case, the connection portion 26 functions as an arrangement order changer configured to change the arrangement order of the contact points 18*a* to 18*e* (38*a* to 38*e*) of the contacts 8*a* to 8*e* (34*a* to 34*e*). FIG. 22 is a perspective view illustrating the configuration of contacts 40*a* to 40*e* in the case of a contact point arrangement order different from a contact portion arrangement order, and FIG. 23 is a plan view of such a configuration from the above.

Figure 23:
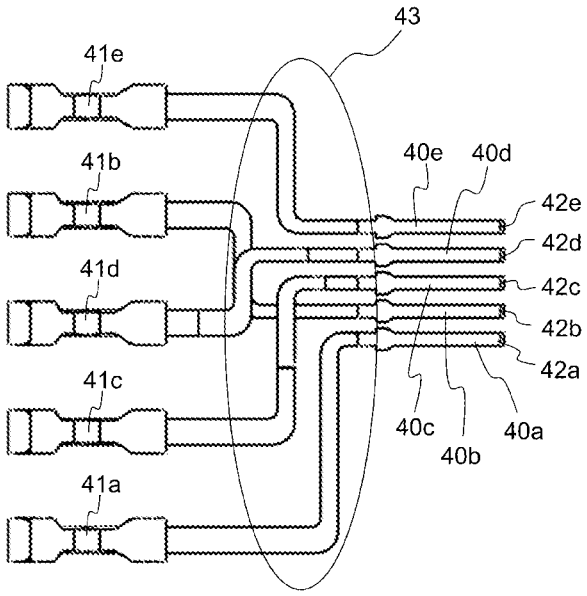
FIG. 23 is a plan view illustrating the other configuration of the contact of the embodiments.

As illustrated in FIGS. 22 and 23, in the case where the arrangement order of contact points 41*a* to 41*e* of the contacts 40*a* to 40*e* is different from that of contact portions 42*a* to 42*e*, a connection portion 43 changes the arrangement order of the contact points 41*a* to 41*e*. That is, the arrangement order of the contact points 41*a* to 41*e* is changed from an arrangement order of 41*a*, 41*b*, 41*c*, 41*d*, 41*e* to an arrangement order of 41*a*, 41*c*, 41*d*, 41*b*, 41*e* in such a manner that the contacts 40*b* to 40*d* are crossed each other.

Figure 24:
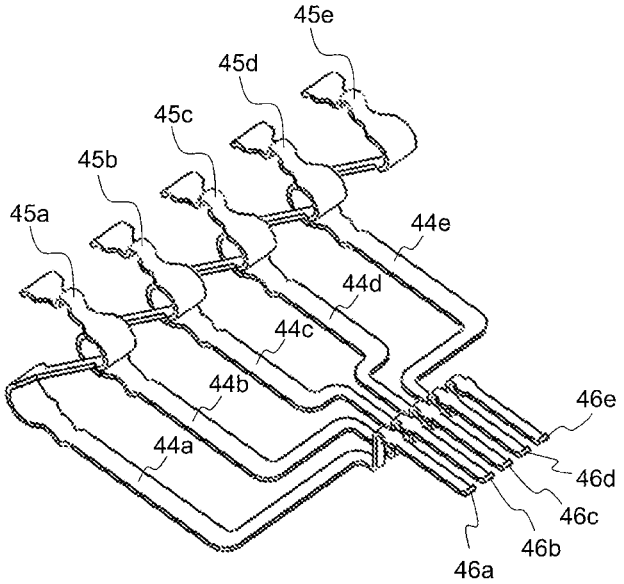
FIG. 24 is a perspective view illustrating the other configuration of the contact of the embodiments.

In each of the above-described embodiments, in the case where the contacts 8*a* to 8*e* (34*a* to 34*e*) has a differential pair, the length from the contact point to the contact portion is preferably the same between two contacts (hereinafter referred to as "first and second contacts") forming the differential pair in order to realize, e.g., high-speed data communication and high-speed charging at the differential pair. FIG. 24 is a perspective view illustrating an example of the configuration of the contacts including the first and second contacts forming the differential pair, and FIG. 25 is a plan view of such an example from the above.

Figure 25:
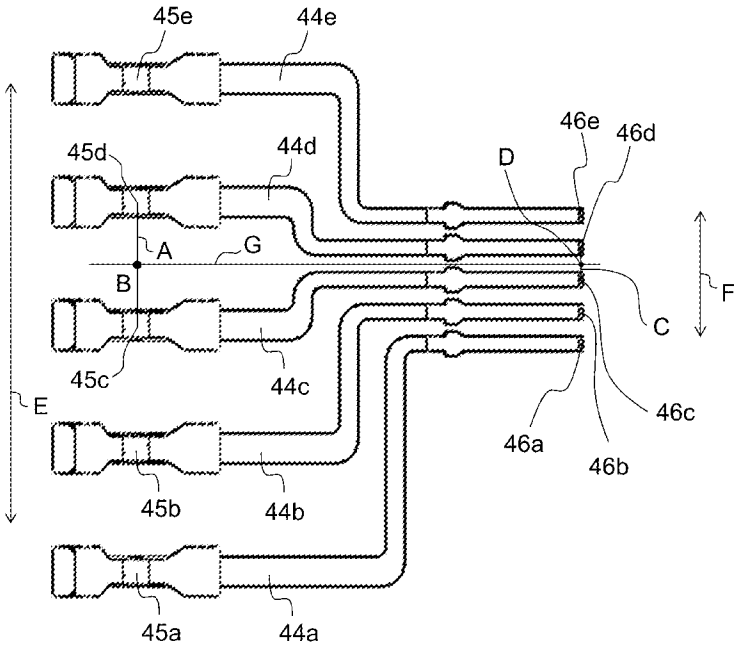
FIG. 25 is a plan view illustrating the other configuration of the contact of the embodiments.

As illustrated in FIGS. 24 and 25, a first contact 44*c* and a second contact 44*d* forming a differential pair are configured such that the length of the first contact 44*c* from a contact point 45*c* to a contact portion 46*c* is the same as the length of the second contact 44*d* from a contact point 45*d* to a contact portion 46*d*. That is, the first contact 44*c* and the second contact 44*d* are, as illustrated in FIG. 25, arranged such that a middle position B of a line A connecting between the contact point 45*c* of the first contact 44*c* and the contact point 45*d* of the second contact 44*d* and a middle position D of a line C connecting between the contact portion 46*c* of the first contact 44*c* and the contact portion 46*d* of the second contact 44*d* are on a line G extending perpendicular to an arrangement direction E of contact points 45*a* to 45*e* of contacts 44*a* to 44*e* and an arrangement direction F of contact portions 46*a* to 46*e* of the contacts 44*a* to 44*e*. Note that a connection portion between the first contact 44*c* and the second contact 44*d* is in a planer shape, and is configured such that the length from the contact point 45*c* to the contact portion 46*c* is the same as the length from the contact point 45*d* to the contact portion 46*d*. With such a configuration, the first contact 44*c* and the second contact 44*d* are easily configured such that the length of the first contact 44*c* from the contact point 45*c* to the contact portion 46*c* is the same as the length of the second contact 44*d* from the contact point 45*d* to the contact portion 46*d*. Moreover, with this configuration, high-speed transmission characteristics can be improved.

Figure 26:
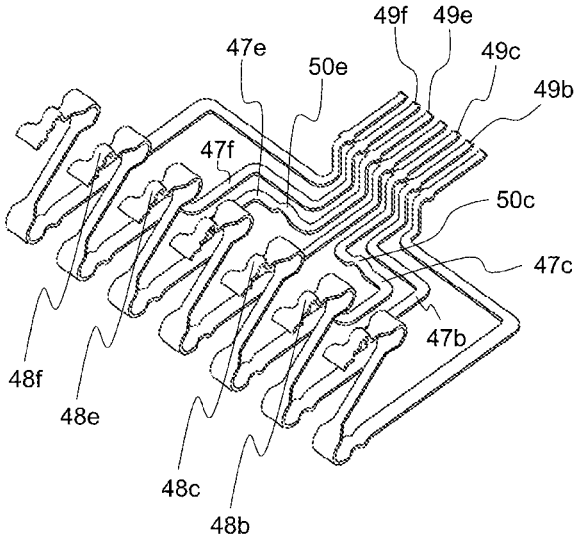
FIG. 26 is a perspective view illustrating the other configuration of the contact of the embodiments.

In the case where contacts include a plurality of differential pairs, the length from a contact point to a contact portion is preferably the same among pairs of first and second contacts each forming the differential pair. FIG. 26 is a perspective view illustrating an example of the configuration of contacts including pairs of first and second contacts forming a plurality of differential pairs. As illustrated in FIG. 26, a first contact 47*b* and a second contact 47*c* forming one of the differential pairs are configured such that the length of the first contact 47*b* from a contact point 48*b* to a contact portion 49*b* is the same as the length of the second contact 47*c* from a contact point 48*c* to a contact portion 49*c*. Specifically, a portion 50*c* connecting between the contact point 48*c* and the contact portion 49*c* in the second contact 47*c* is three-dimensionally formed, and therefore, adjustment is made such that the length of the first contact 47*b* from the contact point 48*b* to the contact portion 49*b* is the same as the length of the second contact 47*c* from the contact point 48*c* to the contact portion 49*c*.

As illustrated in FIG. 26, a first contact 47*e* and a second contact 47*f* forming the other differential pair are configured such that the length of the first contact 47*e* from a contact point 48*e* to a contact portion 49*e* is the same as the length of the second contact 47*f* from a contact point 48*f* to a contact portion 49*f*. Specifically, a portion 50*e* connecting between the contact point 48*e* and the contact portion 49*e* in the first contact 47*e* is three-dimensionally formed, and therefore, adjustment is made such that the length of the first contact 47*e* from the contact point 48*e* to the contact portion 49*e* is the same as the length of the second contact 47*f* from the contact point 48*f* to the contact portion 49*f*. With such a configuration, the high-speed transmission characteristics can be improved.

Figure 27:
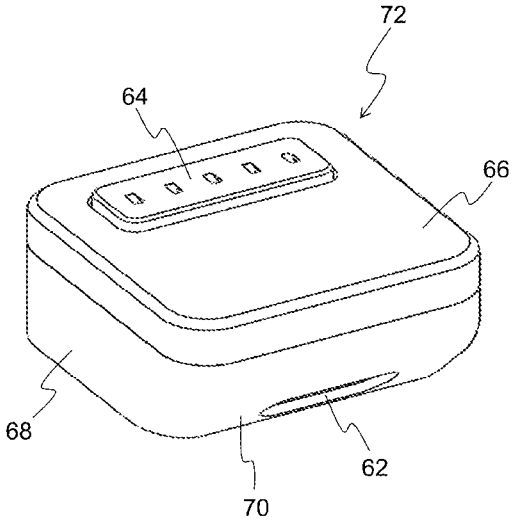
FIG. 27 is a perspective view illustrating the other configuration of the connector of the embodiments.
Figure 28:
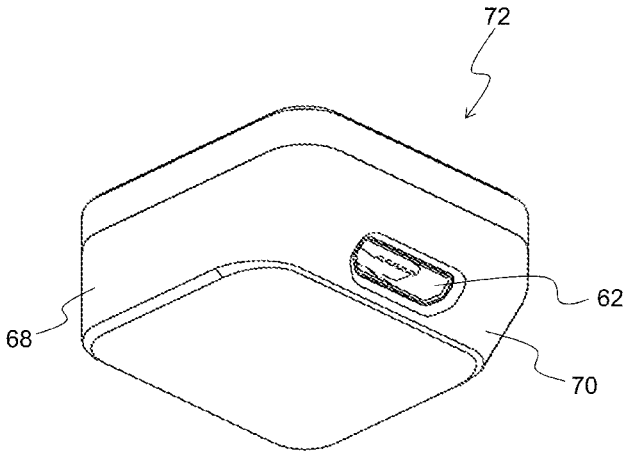
FIG. 28 is a perspective view illustrating the other configuration of the connector of the embodiments.

In the first to third embodiments described above, the connector configured such that the inserting and removing direction of the MicroUSB connector is a substantially parallel direction relative to the opposing surface and that the arrangement direction of the contact points and the arrangement direction of the contact portions are substantially parallel to each other has been described. In the fourth embodiment described above, the connector configured such that the inserting and removing direction of the MicroUSB connector is a substantially perpendicular direction relative to the opposing surface and that the arrangement direction of the contact points and the arrangement direction of the contact portions are substantially parallel to each other has been described. However, a connector may be employed, which is configured such that the inserting and removing direction of a MicroUSB connector is inclined relative to an opposing surface and that the arrangement direction of contact points and the arrangement direction of contact portions are substantially parallel to each other. As illustrated in, e.g., a perspective view of FIG. 27 from the above and a perspective view of FIG. 28 from the below, a connector 72 may be employed, which at a surface 70 of a case body 68 inclined relative to a surface 66 at which a protective case 64 is disposed, includes a receiver 62 configured to receive a MicroUSB connector.

Figure 29:
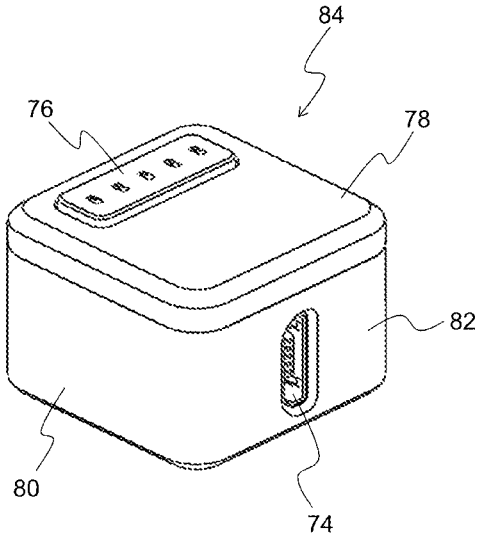
FIG. 29 is a perspective view illustrating the other configuration of the connector of the embodiments.
Figure 30:
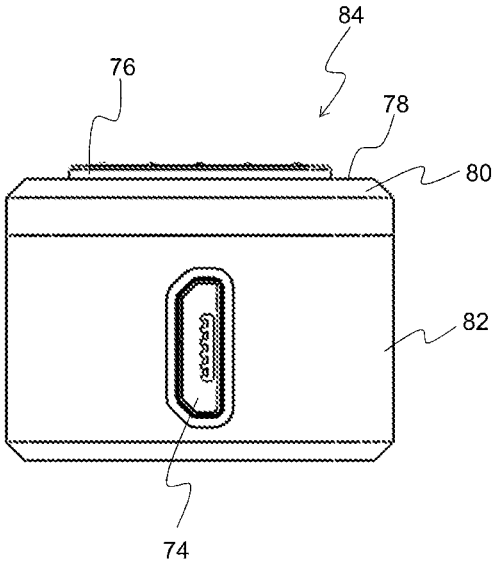
FIG. 30 is a plan view illustrating the other configuration of the connector of the embodiments.
Figure 31:
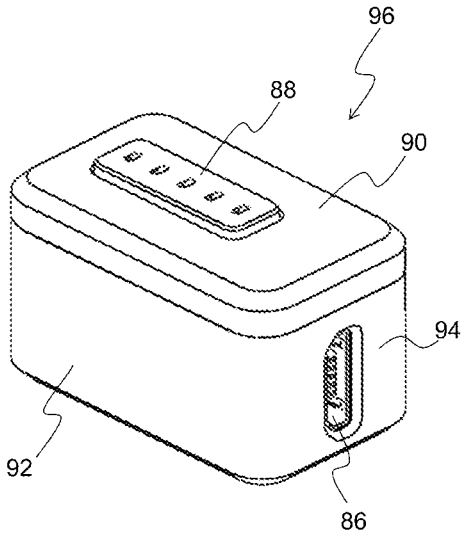
FIG. 31 is a perspective view illustrating the other configuration of the connector of the embodiments.
Figure 32:
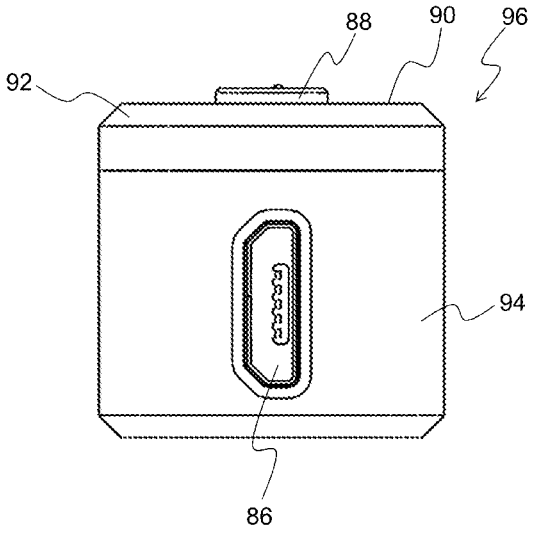
FIG. 32 is a side view illustrating the other configuration of the connector of the embodiments.

A connector may be employed, which is configured such that the inserting and removing direction of a MicroUSB connector is substantially parallel to an opposing surface and that the arrangement direction of contact points and the arrangement direction of contact portions are substantially perpendicular to each other. As in, e.g., a perspective view of FIG. 29 from the above and a plan view of FIG. 30, a connector 84 may be employed, which includes a receiver 74 configured to receive a MicroUSB connector, at a surface 82 of a case body 80 perpendicular to a surface 78 at which a protective case 76 is disposed. Alternatively, as in, e.g., a perspective view of FIG. 31 from the above and a side view of FIG. 32, a connector 96 may be employed, which at a surface 94 of a case body 92 perpendicular to a surface 90 at which a protective case 88 is disposed, includes a receiver 86 configured to receive a MicroUSB connector.

A connector may be employed, which is configured such that the inserting and removing direction of a MicroUSB connector is substantially perpendicular to an opposing surface and that the arrangement direction of contact points and the arrangement direction of contact portions are substantially perpendicular to each other. Alternatively, a connector may be employed, which is configured such that the inserting and removing direction of a MicroUSB connector is inclined relative to an opposing surface and that the arrangement direction of contact points and the arrangement direction of contact portions are substantially perpendicular to each other.

In each of the above-described embodiments, the MicroUSB connector has been described as an example of a connector for external connection. However, other connector such as a USBType-C connector or a USB3.1 connector may be used as the connector for external connection.

In each of the above-described embodiments, the connector including the magnets as the fixing portions has been described as an example. However, a connector may be employed, which includes, e.g., a mechanical lock with a claw instead of a magnet. In this case, the mechanical lock is also preferably provided at a lower case having a holder (a holding surface) in order to prevent separation of upper and lower cases.

The above-described embodiments have been described for the sake of ease of understanding of the present invention, and are not intended to limit the scope of the present invention. Thus, each element disclosed in the above-described embodiments includes all design changes and equivalents falling within the technical scope of the present invention.

The invention claimed is:

1. A connector comprising:

a case comprising an opposing surface facing an external device; and at least one flat plate-shaped contact built in the case, wherein the case includes:

a first opening which is formed at the opposing surface and through which a contact point of the at least one flat plate-shaped contact to be connected to a connection terminal of the external device protrudes from the opposing surface, a receiver configured to receive a connector for an external connection, a holder configured to hold the at least one flat plate-shaped contact, a case body including the receiver and the holder, and a protective case including the opposing surface formed with the first opening, and the at least one flat plate-shaped contact includes:

the contact point which is disposed in the first opening and which is to contact with the connection terminal of the external device, an elastic portion which is disposed in the case and which moves the contact point in a substantially perpendicular direction relative to the opposing surface, a contact portion which is disposed in the receiver and which is to contact with a connection terminal of the connector for external connection, a held portion which is formed between the elastic portion and the contact portion and which is held by the holder in the case, and a connection portion which is formed between the elastic portion and the contact portion and which connects between the contact point and the contact portion in the case, wherein the case body includes a second opening for attachment of the protective case at a surface of the case body facing the external device, and the protective case is attached to the second opening of the case body to move in the substantially perpendicular direction relative to the opposing surface.

2. The connector according to claim 1, wherein:

the at least one flat plate-shaped contact comprises a plurality of contacts, and the connection portion includes a pitch changer configured to, when an arrangement pitch of the contact points of the plurality of contacts and an arrangement pitch of the contact portions of the plurality of contacts are different from each other, change the arrangement pitch of the contact points of the plurality of contacts.

3. The connector according to claim 1, wherein the connector for the external connection is a MicroUSB connector, a USBType-C connector, or a USB 3.1 connector.

4. The connector according to claim 1, wherein an inserting and removing direction of the connector for the external connection is a substantially parallel direction relative to an opposing surface direction, a substantially perpendicular direction relative to the opposing surface, or a direction inclined relative to the opposing surface, and an arrangement direction of the contact points and an arrangement direction of the contact portions are substantially parallel to each other.

5. The connector according to claim 1, wherein an inserting and removing direction of the connector for the external connection is a substantially parallel direction relative to an opposing surface direction, a substantially perpendicular direction relative to the opposing surface, or a direction inclined relative to the opposing surface, and an arrangement direction of the contact points and an arrangement direction of the contact portions are substantially perpendicular to each other.

6. The connector according to claim 1, further comprising:

a fixing portion configured to, while the contact point is connected to the connection terminal of the external device, fix the external device on the case.

7. The connector according to claim 6, wherein the case includes a first case comprising a surface facing the external device and a second case comprising the holder, the first and second cases are connected together in a direction facing the external device, and the fixing portion is provided at the second case.

8. The connector according to claim 1, further comprising:

a first shell which is inserted into the case and which includes, at a surface facing the external device, a connecting portion to be connected to the external device; and a second shell which is formed in the receiver and which contacts the first shell, wherein the first shell is in such a shape that the first shell covers at least the elastic portion and the held portion.

9. A connector comprising:

a case comprising an opposing surface facing an external device; and a plurality of flat plate-shaped contacts built in the case, wherein the case includes:

first openings which are formed at the opposing surface and through which contact points of the plurality of flat plate-shaped contacts to be connected to connection terminals of the external device protrude from the opposing surface, a receiver configured to receive a connector for an external connection, and a holder configured to hold the plurality of flat plate-shaped contacts, and each of the plurality of flat plate-shaped contacts includes:

a contact point which is disposed in the first opening and which is to contact with the connection terminal of the external device, an elastic portion which is disposed in the case and which moves the contact point in a substantially perpendicular direction relative to the opposing surface, a contact portion which is disposed in the receiver and which is to contact with a connection terminal of the connector for external connection, a held portion which is formed between the elastic portion and the contact portion and which is held by the holder in the case, and a connection portion which is formed between the elastic portion and the contact portion and which connects between the contact point and the contact portion in the case, wherein the connection portion includes an arrangement order changer configured to, when an arrangement order of the contact points of the plurality of flat plate-shaped contacts and an arrangement order of the contact portions of the plurality of flat plate-shaped contacts are different from each other, change the arrangement order of the contact points of the plurality of flat plate-shaped contacts.

10. The connector according to claim 9, wherein the case includes a case body including the receiver and the holder, and a protective case including the opposing surface formed with the first opening, the case body includes a second opening for attachment of the protective case at a surface of the case body facing the external device, and the protective case is attached to the second opening of the case body to move in the substantially perpendicular direction relative to the opposing surface.

11. The connector according to claim 9, wherein an inserting and removing direction of the connector for the external connection is a substantially parallel direction relative to an opposing surface direction, a substantially perpendicular direction relative to the opposing surface, or a direction inclined relative to the opposing surface, and an arrangement direction of the contact points and an arrangement direction of the contact portions are substantially parallel to each other.

12. The connector according to claim 9, wherein an inserting and removing direction of the connector for the external connection is a substantially parallel direction relative to an opposing surface direction, a substantially perpendicular direction relative to the opposing surface, or a direction inclined relative to the opposing surface, and an arrangement direction of the contact points and an arrangement direction of the contact portions are substantially perpendicular to each other.

13. The connector according to claim 9, further comprising:

a fixing portion configured to, while the contact point is connected to the connection terminal of the external device, fix the external device on the case.

14. A connector comprising:

a case comprising an opposing surface facing an external device; and a plurality of flat plate-shaped contacts built in the case, wherein the case includes:

first openings which are formed at the opposing surface and through which contact points of the plurality of flat plate-shaped contacts to be connected to connection terminals of the external device protrude from the opposing surface, a receiver configured to receive a connector for an external connection, and a holder configured to hold the plurality of flat plate-shaped contacts, and each of the plurality of flat plate-shaped contacts includes:

a contact point which is disposed in the first opening and which is to contact with the connection terminal of the external device, an elastic portion which is disposed in the case and which moves the contact point in a substantially perpendicular direction relative to the opposing surface, a contact portion which is disposed in the receiver and which is to contact with a connection terminal of the connector for external connection, a held portion which is formed between the elastic portion and the contact portion and which is held by the holder in the case, and a connection portion which is formed between the elastic portion and the contact portion and which connects between the contact point and the contact portion in the case, wherein the plurality of flat plate-shaped contacts include first and second contacts forming a differential pair, and the first and second contacts are configured such that a length of the first contact from a contact point to a contact portion is identical to a length of the second contact from a contact point to a contact portion.

15. The connector according to claim 14, wherein the first and second contacts are formed in a planar or three-dimensional shape.

16. The connector according to claim 14, wherein the first and second contacts are arranged such that a middle position of a line connecting between the contact point of the first contact and the contact point of the second contact and a middle position of a line connecting between the contact portion of the first contact and the contact portion of the second contact are on a line extending perpendicular to an arrangement direction of the contact points and an arrangement direction of the contact portions.

17. The connector according to claim 14, wherein the case includes a case body including the receiver and the holder, and a protective case including the opposing surface formed with the first opening, the case body includes a second opening for attachment of the protective case at a surface of the case body facing the external device, and the protective case is attached to the second opening of the case body to move in the substantially perpendicular direction relative to the opposing surface.

18. The connector according to claim 14, wherein the connector for the external connection is a MicroUSB connector, a USBType-C connector, or a USB 3.1 connector.

19. The connector according to claim 14, wherein the connection portion includes a pitch changer configured to, when an arrangement pitch of the contact points of the plurality of flat plate-shaped contacts and an arrangement pitch of the contact portions of the plurality of flat plate-shaped contacts are different from each other, change the arrangement pitch of the contact points of the plurality of flat plate-shaped contacts.

20. The connector according to claim 14, further comprising:

a first shell which is inserted into the case and which includes, at a surface facing the external device, a connecting portion to be connected to the external device; and a second shell which is formed in the receiver and which contacts the first shell, wherein the first shell is in such a shape that the first shell covers at least the elastic portion and the held portion.

* * * * *